United States Patent [19]

Jaedicke et al.

[11] 4,165,730

[45] Aug. 28, 1979

[54] SPRING SUPPORT IN A COMPRESSED AIR FIREARM

[75] Inventors: Ludwig Jaedicke, Thalfingen; Dieter Straub, Ulm, both of Fed. Rep. of Germany

[73] Assignee: J. G. Anschütz GmbH, Ulm, Fed. Rep. of Germany

[21] Appl. No.: 813,308

[22] Filed: Jul. 6, 1977

[30] Foreign Application Priority Data

Jul. 26, 1976 [DE] Fed. Rep. of Germany ..... 2633519

[51] Int. Cl.[2] ..... F41B 11/00; F41F 1/04

[52] U.S. Cl. ..... 124/67

[58] Field of Search ..... 124/66, 67, 68; 267/168

[56] References Cited

U.S. PATENT DOCUMENTS

| | | | |
|---|---|---|---|
| 3,556,504 | 1/1971 | Sinclair | 267/168 |

FOREIGN PATENT DOCUMENTS

| | | | |
|---|---|---|---|
| 1843955 | 12/1961 | Fed. Rep. of Germany | 124/67 |
| 34754 | 7/1952 | Poland | 124/67 |
| 380036 | 9/1932 | United Kingdom | 124/67 |
| 368082 | 3/1973 | U.S.S.R. | 267/168 |

*Primary Examiner*—Richard T. Stouffer

*Attorney, Agent, or Firm*—Holman & Stern

[57] ABSTRACT

A spring support tube for the two helical compression springs loading a piston in a compressed air firearm consisting of at least two tube portions freely movable relatively to one another in the axial direction. The portions can be of the same diameter and disposed one behind the other in the annular space between the springs or being in sliding connection with each other. The sliding connection can be either telescopic or in a tongue and slot arrangement.

10 Claims, 5 Drawing Figures

SPRING SUPPORT IN A COMPRESSED AIR FIREARM

The invention relates to a compressed air firearm with spring support tube, with a compression cylinder and a compression piston axially displaceable therein, which is loaded by two cylindrical helical compression springs of different diameters, disposed concentrically one inside the other, and can be held fast by a pull-off or trigger device in the compressed position, and when the shot is fired, can be released again. The spring support tube is located in an annular space between the two helical compression springs or surrounds the outer of the two helical compression springs or is surrounded by the inner one.

Spring support tubes disposed in the annular space between the helical springs are known (German Gebrauchsmuster No. 1 843 955). Such a spring support tube serves the purpose of protecting the one of the two helical compression springs which is not guided and supported by any structural component, for example, the piston rod fixed to the compression piston or a piston sheath tube, from kinking. The spring support tube may, however, at a maximum, only be as long as the helical compression springs when compressed for the shot. This is in order to utilize the full spring travel, and for the compression piston during stressing to not be locked before it has reached its distant travel end position. The disadvantage must therefore be taken into consideration, that during the forward travel of the compression piston during the shot and after it has encountered the cylinder head near the barrel, the helical compression spring originally completely supported by the spring support tube, remains without support to an increasing degree over a large portion of its length. The actual length of this is up to the maximum piston travel length.

As an unacceptable consequence of this it is possible for the helical compression spring only now partly supported by the spring support tube, to kink, and during the progress of the shot, to rub against the other spring. This causes oscillations, which also have a deleterious effect on the action of the weapon and result in misses due to defects in the manner in which the shot leaves the muzzle.

Admittedly the problem can easily be solved if a single helical compression spring equivalent to the twin springs, is incorporated. However, such a spring with the desired durability requires more space than is available.

The object of the invention is to provide a spring support tube which permits the requisite freedom of movement to the compression piston, but nevertheless prevents any contact of the two helical compression springs over their whole length in all possible relative positions.

This object is attained in accordance with the invention in that the spring support tube consists of at least two tubular portions (which are not fixedly connected to one another) freely movable relatively to one another in the axial direction. In a preferred embodiment, the tube portions are disposed with tube sections equal in diameter, and with smooth end surfaces aligned one behind the other.

Because of this arrangement, the individual tube portions during the occurrence of the shot are conjointly entrained by the expanding spring coils adjacent to them, by different amounts in the expansion direction of the helical compression springs. As a result of this, the support zones formed by the tube portions also travel and are distributed almost regularly over the spring length available at that particular point of time. Thus, there are always alternate support zones and gaps following one another in succession.

The advantages obtained consist in particular in that the helical compression spring to be supported, is not supported merely over a coherent part of its length and not over the remaining portion, but small support zones alternate with short unsupported zones. The helical compression spring can not kink, in the short unsupported zones between two tube portions of the spring support tube, so far transversely to the longitudinal axis that the coils of the other spring come into contact. In this way, however, not only is any excitation of oscillations prevented, but longitudinal oscillations of the helical compression springs due to other causes, are effectively damped by friction.

Another embodiment of the spring support tube consists in that the tube component members forming the spring support tube are tube portions of equal diameter, whose inner end faces turned towards an adjacent tube portion, are made meandering, in alternate successie depths, having cut-away portions and shoulders or steps extending in the tube longitudinal direction, to which corresponding shoulders and cut-away portions of the adjacent tube portion are assigned, and whose terminal end faces not facing any adjacent tube portion, have a radially outwardly or inwardly turned flange or collar.

The embodiment when the number of components is restricted to two is most favorable for production and operation. The two components then engage in one another like the two parts of a dog clutch and can be displaced one another in the axial direction right up to the full length of their shoulders and cut-away portions without losing contact with one another. The length of the shoulders or cut-away portions should therefore be somewhat greater than the maximum piston travel. The two ends either of the inner or of the outer helical compression springs rest on the terminal flanges or collars of the two components of the spring tube, so that these components are fixedly chucked. The special advantage of this embodiment consists in that the continuity of the spring support is never interrupted during the whole piston stroke over the whole spring length.

The same advantage is also obtained with a third embodiment in which the components forming the spring support tube are tube portions of different diameters, telescopically insertable one inside the other, with terminal flanges or collars. The tube portions should be relatively thin-walled so that the telescope stages do not interfere with the springs. In other respects what was said regarding the second form of embodiment applies here mutatis mutandis.

A number of examples of embodiment are represented in the drawings and will be described in what follows in more detail.

Figure 1:
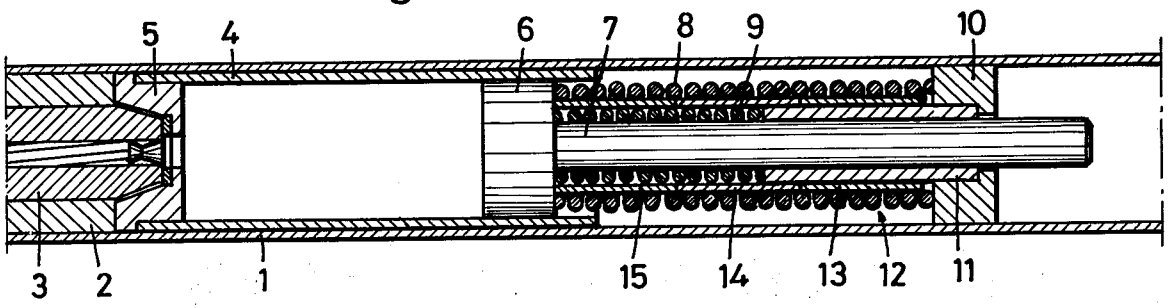
FIG. 1 shows in longitudinal section a part view of a compressed air firearm ready for firing, with the first embodiment of the spring support tube.
Figure 2:
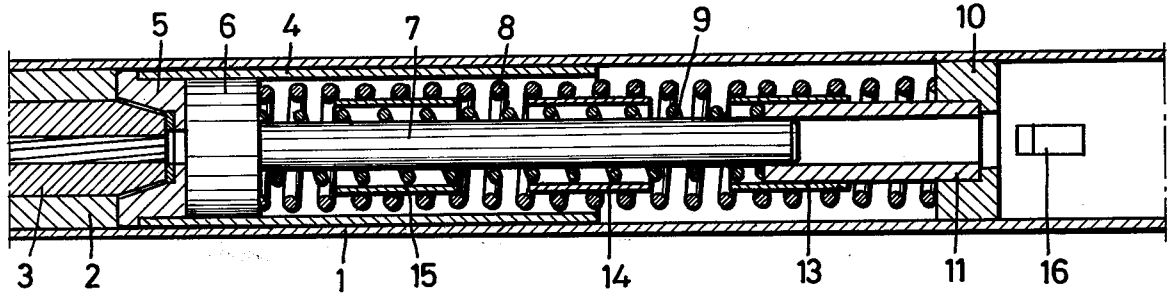
FIG. 2 shows a compressed air firearm as in FIG. 1, after the shot.

FIGS. 1 and 2 show a weapon housing 1, to which a barrel 3 is fixed by means of a filling piece 2. The weapon housing 1 encloses an axially displaceable compression cylinder 4 with a cylinder head 5. A compression piston 6 with a piston rod 7 fixed to it, is supported so as to be longitudinally movable in the compression cylinder 4 and is loaded by two helical compression springs 8 and 9, disposed concentrically one inside the other, in the direction of the barrel 3. The two helical compression springs 8 and 9 have different hands of lay. The outer helical compression spring 8 is applied by its end opposite the compression piston 6, against a spring support bearing 10 which is fixedly inserted or welded into the part remote from the barrel of the weapon housing 1. A sleeve 11 is irremovably fitted in this spring support bearing 10, the duty of which is to guide the piston rod 7 and to form a counterbearing, for the inner helical compression spring 9. With regard to the construction and arrangement of these and all other details, reference is expressly made to the drawing.

In the annular space between the two helical compression springs 8 and 9, or between the outer helical compression spring 8 and the sleeve 11, there is disposed a three-part spring support tube 12, consisting of tube portions 13, 14 and 15 of equal diameter and equal axial length which prevent any kinking out of the outer helical compression spring 8. These three tube portions 13, 14 and 15 are supported partly on the inner helical compression spring 9, which in turn is guided on the piston rod 7.

FIG. 2 shows the weapon in the unstressed condition. The weapon is converted from this into the tensional, ready-to-fire condition, in accordance with FIG. 1, in a known manner wherein the compression cylinder 4 and the compression piston 6 are displaced with a tensioning lever (not shown) against the direction of shooting until a catch-pawl 16 catch engages in the free end of the piston rod 7.

If the compression cylinder 4 is then again moved by the tensioning lever in the barrel direction, the catch-pawl 16 holds the compression piston 6 fast in the tensioning position until release from catch engagement is effected by a pull-off or trigger device (not shown). At the moment of discharge of the shot, the helical compression springs 8 and 9 force the compression piston 6 forward in the shot direction, in which connection their stretching conjointly entrains the three tube portions 13, 14 and 15 by frictional force. Since the spring coils here pass over a distance comparatively equal to their particular distance from the spring support bearing 10 or the sleeve 11, the tube portion 15 is moved further than the tube portion 14 and this again is moved further than 13. In this way, approximately equal-sized gaps are formed between the tube portions in respect of one another, and between the terminal tube portions and the spring ends. The greater the number and block lengths of the tube portions, the shorter the gaps. The total length of the tube portions when pushed together should however still be somewhat smaller than the lengths of the compression spring 8 in the compressed condition (FIG. 1). Even with three tube portions, under the given conditions represented in FIGS. 1 and 2, any kinking-out of the compression spring 8 is securely avoided.

Figure 4:
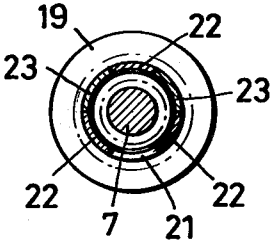
FIG. 4 is a cross-section through the arrangement of FIG. 3 along line IV—IV.
Figure 3:
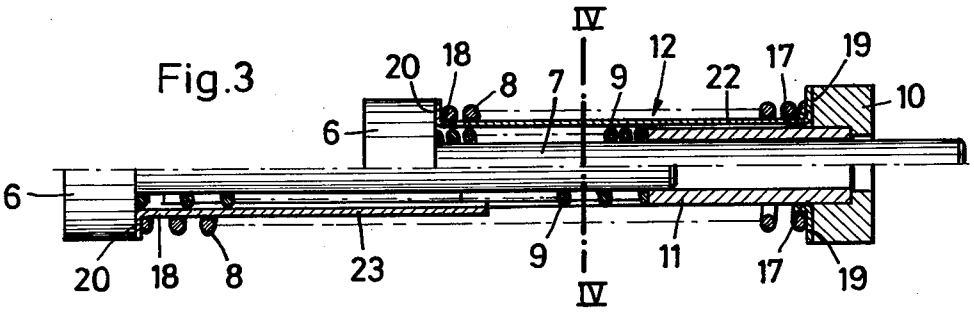
FIG. 3 shows the most important functional parts of FIGS. 1 and 2 with the second embodiment of the spring support tube in longitudinal section, wherein the arrangement in the upper half is represented before firing and in the lower half after firing.

FIGS. 3 and 4 show another form of the spring support tube 12. Here it consists of two cylindrical tube portions 17 and 18, equal in diameter and also of equal length, each with a terminal flange or collar 19 or 20, on which the helical compression spring 8 bears. The tube portion 17 has three rectangular cut-away portions or cut-outs 21 (FIG. 4) taking in practically the whole tube length, distributed uniformly round the periphery, starting from its inner end face, and dividing the tube envelope into three steps or shoulders 22 of the same width and length. Gapless shoulders 23 of the tube portion 18, which are formed in the same way, engage in these cut-outs 21. All the shoulders and cut-outs should be somewhat longer than the piston stroke, so that the tube portions 17 and 18 do not lose contact with one another during operation. On the other hand they are somewhat shorter than the length of the compression spring 8 in the compressed condition.

Figure 5:
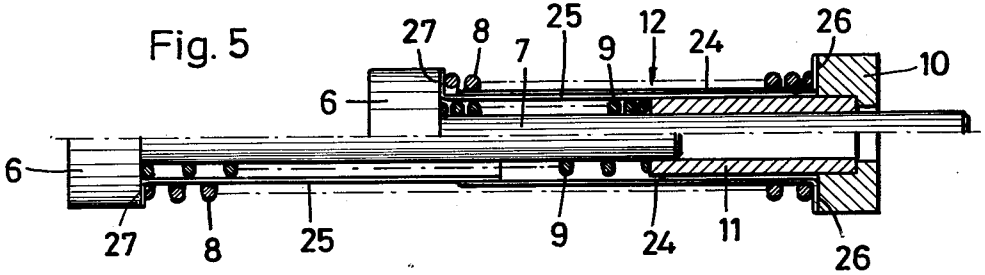
FIG. 5 shows the most important functional parts of FIGS. 1 and 2 with the third embodiment of the spring support tube in longitudinal section, wherein the arrangement in the upper half is represented before firing and in the lower half after firing.

FIG. 5 shows a third form of the spring support tube 12. Two cylindrical thin-walled tube portions 24 and 25, are telescopically inserted one inside the other and each has a terminal flange or collar 26 or 27. These two telescopic tubes can be drawn apart up to the maximum piston stroke length, without deleteriously affecting their supporting capacity. The length of each of the two telescopic tubes of different diameter is less than the length of the compression spring 8 in the compressed condition.

Although the spring support tubes are shown and described as being located in the annular space between the helical springs, it is readily understood that the support tubes could also surround the outer compression spring or be surrounded by the inner compression spring and still have substantially the same advantages over the support tubes of the prior art.

What is claimed is:

1. In a compressed air firearm with spring support tube, comprising a cylindrical housing having an axis, a compression cylinder mounted in said housing, a compression piston axially displaceable in said cylinder, two cylindrical helical compression springs of different diameter loading said piston in parallel to each other, said springs being disposed concentrically one inside the other axially in said housing and being arranged to be held fast in the compressed position by a trigger device, and after shooting to be released again, and a spring support tube axially aligned and supportingly associated with said two helical compression springs, the improvement wherein said spring support tube comprises at least two tube portions freely movable relatively to one another in the axial direction, each having a diameter, a length and end surfaces, said tube portions radially supporting at least one of said springs and not axially transfer load to each other.

2. The improvement of claim 1, wherein said tube portions are of the same diameter and are disposed in alignment one behind the other.

3. The improvement of claim 2, wherein said tube portions have the same axial lengths.

4. The improvement of claim 2, wherein said tube portions are guided in the axial direction between the concentric helical springs and are in frictional contact with at least one of the helical springs.

5. The improvement of claim 2, wherein said tube portions have smooth end surfaces lying in planes perpendicular to the axial direction.

6. The improvement of claim 5, wherein said tube portions are guided in the axial direction between the concentric helical springs and are in frictional contact with at least one of the helical springs.

7. The improvement of claim 2, wherein three tube portions are provided.

8. The improvement of claim 7, wherein said tube portions are guided in the axial direction between the concentric helical springs and are in frictional contact with at least one of the helical springs.

9. The improvement of claim 1, wherein said tube portions are of equal diameter and have at the end faces facing the adjacent tube portion, meander-shaped, alternating succeeding, deep cut-away portions and shoulders extending in the tube longitudinal direction, to which there are assigned corresponding shoulders and cut-away portions of the adjacent tube portion, and each of the end faces not facing an adjacent tube portion has a radially outwardly or inwardly directed flange, on which at least one of the helical springs bears.

10. The improvement of claim 1, wherein said tube portions are different in diameter and are inserted one inside the other telescopically, and have at the non-inserted end faces a radially outwardly or inwardly flange on which at least one of the helical springs bears.

* * * * *